United States Patent [19]

Tschirner

[11] 4,408,362

[45] Oct. 11, 1983

[54] METHOD FOR CONTINUOUSLY TREATING STRAND-LIKE TEXTILE MATERIAL IN VERTICAL LOOPS

[75] Inventor: Wolfgang Tschirner, Tönisvorst, Fed. Rep. of Germany

[73] Assignee: Kleinewefers, Jaeggli AG, Rümikon, Switzerland

[21] Appl. No.: 394,705

[22] Filed: Jul. 2, 1982

Related U.S. Application Data

[62] Division of Ser. No. 198,051, Oct. 17, 1980, Pat. No. 4,370,872.

[30] Foreign Application Priority Data

Oct. 17, 1979 [DE] Fed. Rep. of Germany ..... 2941900

[51] Int. Cl.[3] ..... D06B 3/28

[52] U.S. Cl. ..... 8/151

[58] Field of Search ..... 68/158, 175, 181 R, 68/183, 184, 207; 226/104, 118, 119; 8/151

[56] References Cited

U.S. PATENT DOCUMENTS

| | | | |
|---|---|---|---|
| 2,612,770 | 10/1952 | Fahringer | 68/158 |
| 3,849,068 | 11/1974 | Meier-Windhorst | 68/181 R X |
| 3,978,696 | 9/1976 | Ito et al. | 68/158 |
| 4,059,974 | 11/1977 | Fleissner | 68/158 X |

FOREIGN PATENT DOCUMENTS

| | | | |
|---|---|---|---|
| 77037 | 1/1955 | Netherlands | 68/184 |

*Primary Examiner*—Philip R. Coe
*Assistant Examiner*—Thomas W. Epting
*Attorney, Agent, or Firm*—Becker & Becker, Inc.

[57] ABSTRACT

A method for continuously treating strand-like textile material which is transported horizontally in vertical loops, by way of transverse rods or bars, through a treatment liquid, particularly a hot mixture of liquids; the formation of the loops occurs by way of vertical flow. The loop formation, the maintaining of the formed loop, the form or shape stability thereof, as well as the horizontal movement thereof are effected by transverse rods or bars, which are arranged in the lower loop bends and in the vicinity of the container bottom move from the textile strand inlet or entry side of the textile strand outlet or discharge side, and by a flow directed upwardly between the transverse rods or bars; the horizontal movement is aided by a horizontal transverse flow of the treatment liquid. The apparatus for carrying out the foregoing method includes a cubic or quadratic liquid container, and an endless chain which is guided in the vicinity of the container bottom and the container end walls and is provided with transverse rods or bars of greater width than that of the textile strand to be treated. The apparatus further includes an air permeable and liquid permeable stationary support or overlay which is inclined relative to the horizontal from the textile strand inlet or entry side to the textile strand outlet or discharge side of the container. The apparatus also includes a pair of rails in the vicinity of the container bottom for the transverse rods or bars, of the endless chain, moved thereon, and upwardly directed nozzles located below the support or overlay as well as a device for generating the transverse flow.

4 Claims, 6 Drawing Figures

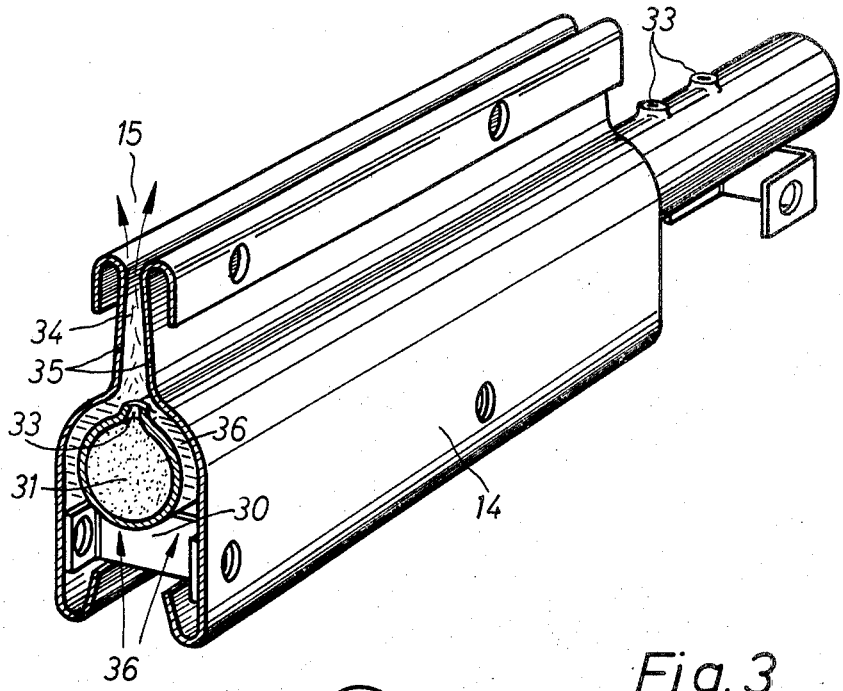
Fig. 3
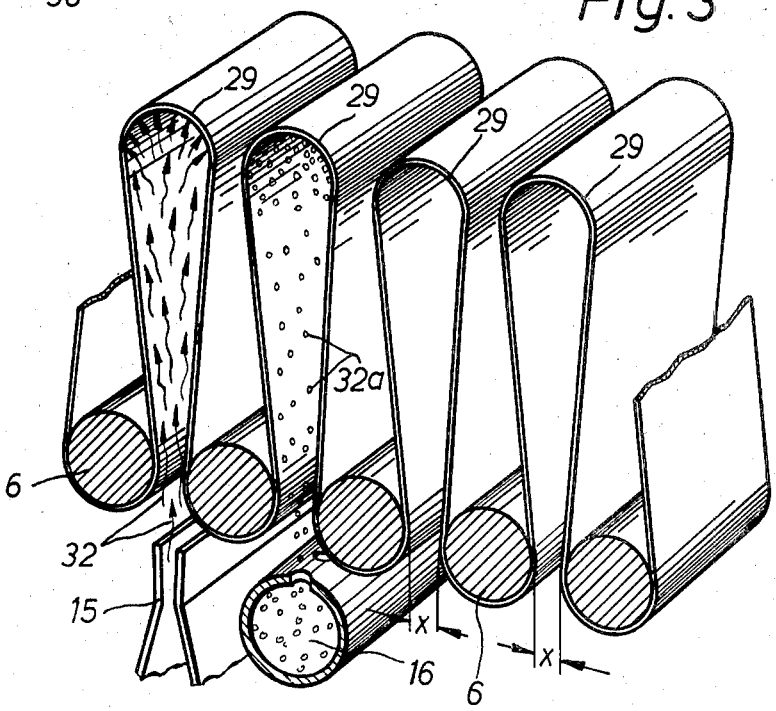

METHOD FOR CONTINUOUSLY TREATING STRAND-LIKE TEXTILE MATERIAL IN VERTICAL LOOPS

This is a divisional application of co-pending parent application Ser. No. 198,051—Tschirner, filed Oct. 17, 1980, now U.S. Pat. No. 4,370,872.

The present invention relates to a method for continuously treating strand-like textile material which is transported horizontally in vertical loops by means of transverse bars, through a treatment liquid, particularly a hot mixture of liquids; the formation of the loops occurs by means of a vertical flow.

German Offenlegungsschrift No. 25 20 748 discloses an apparatus according to which the loops of the textile strand are formed between two horizontal endless perforated bands or belts which are spaced from one another and the band segments of which move in the treatment container from the inlet or entry side of the textile strand to the outlet or discharge side thereof. This known method permits only short loops of at most 0.5 meter height; essential, however, is that the loops, in the longitudinal direction of the textile material strand, change their position relative to the textile material strand, and the side walls of the loops under these circumstances are folded and kinked or bent, which leads to bent folds or kinks, especially during a treatment, particularly in a hot mixture of liquid, and the marking of such bent folds in a subsequent procedure of treatment of the textile strand can no longer be removed. (FIG. 3 of German Offenlegungsschrift No. 25 20 748).

German trade magazine "Melliand-Textile Reports, 2/1978, Pages 143–146", discloses an apparatus of the initially mentioned type, according to which the loops are looped about rollers or crosspieces which are horizontally guided in the upper segment of the treatment container. The formation of the loops and the obtaining of the form or shape stability are effected in this connection by means of a liquid flow directed counter to the natural lift of the textile loops in the liquid, whereby the liquid is withdrawn over the width and length of the bottom of the treatment container. The horizontal transverse movement of the loops is effected by the rollers and crosspieces. A strong downwardly directed flow must be used to achieve vertical loops during drawing or pulling of the same by means of the rollers or crosspieces in the upper container section.

It is therefore an object of the present invention to carry out the treatment of the textile strand with a low energy requirement, to achieve a higher treatment speed and a high loop length, and to obtain loops that are as vertical as possible as well as being free of any kinks, bends or folds. Collectively, the apparatus utilized for this purpose should have a simple construction.

These and other objects and advantages of the present invention will appear more clearly from the following specification in connection with the accompanying drawings, in which:

FIG. 2 is a view illustrating a device for generating aerodynamic or hydrodynamic lift or buoyancy in the liquid, and being arranged in the vicinity of the container bottom;

FIG. 3 is a perspective view of successive loops in a shortened illustration;

Figure 1:
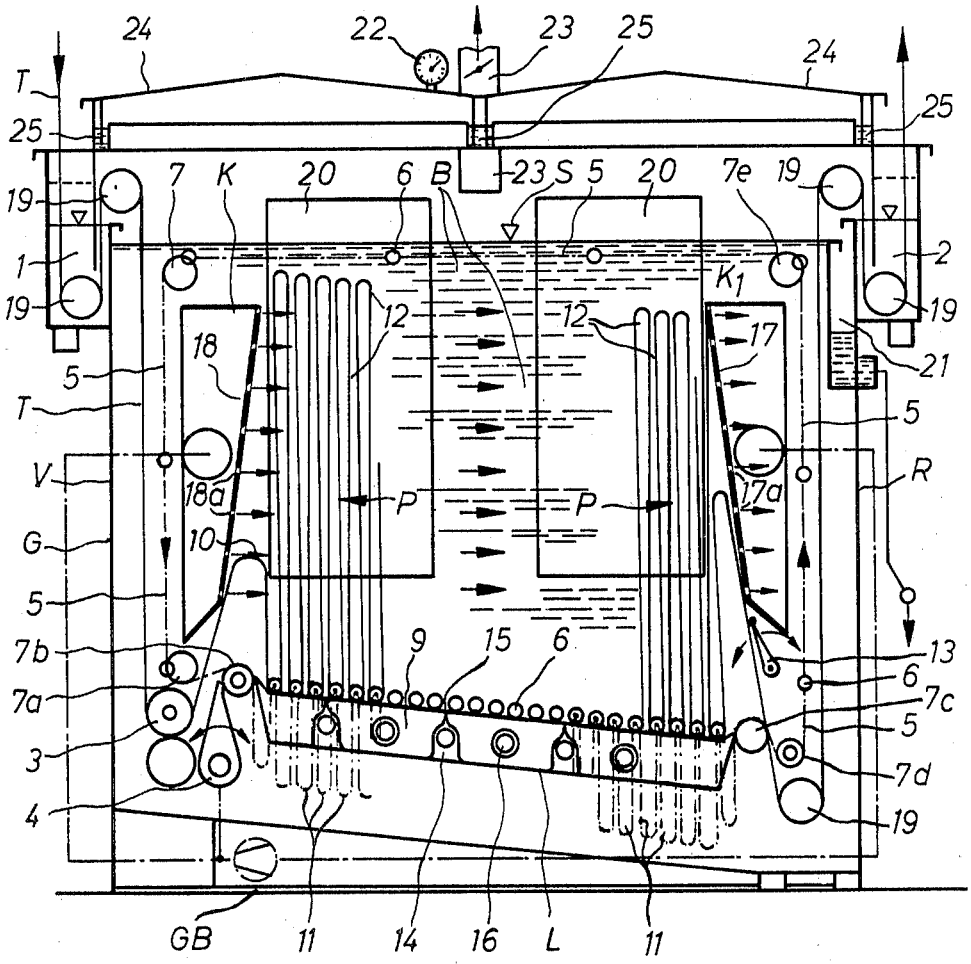
FIG. 1 is a schematic illustration of one embodiment of the apparatus of the present invention shown in a vertical section.
Figure 4:
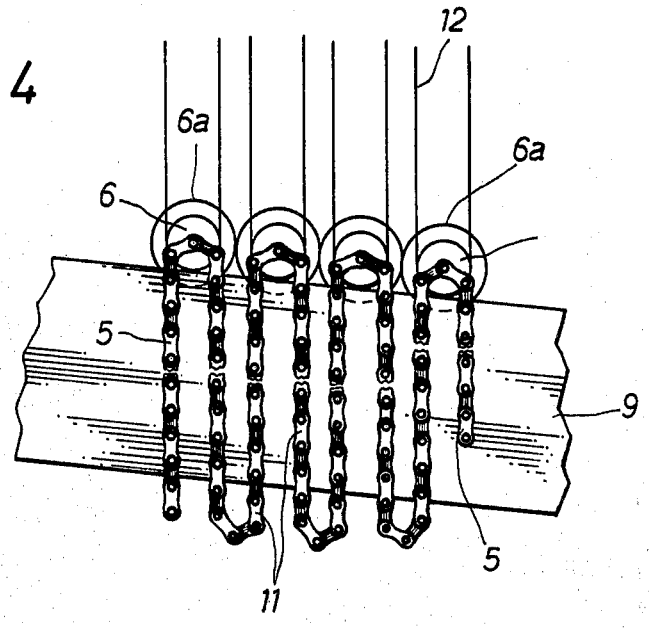
FIG. 4 is a view illustrating a segment of the chain guidance of the stud-like or roller chain.
Figure 5:
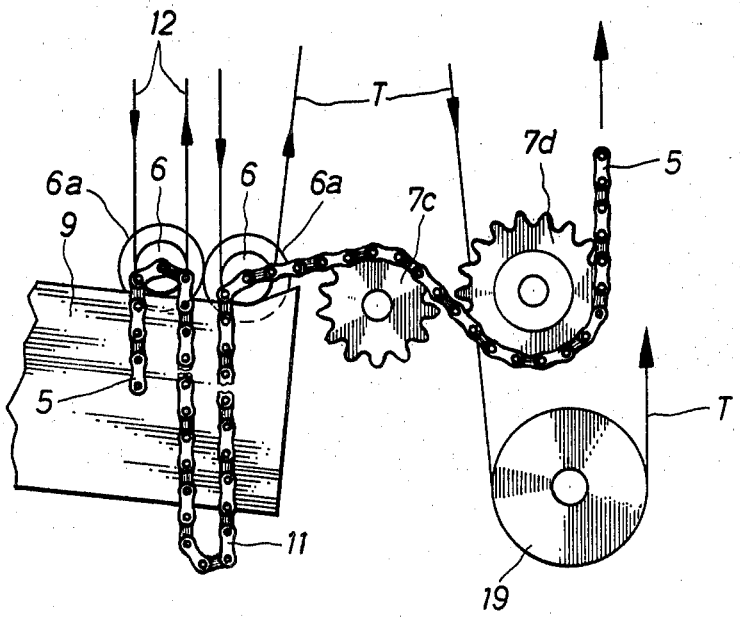
FIG. 5 illustrates another segment of the chain guidance of the stud-link or roller chain.

The method of the present invention is characterized primarily in that the loop formation, the maintaining of the formed loop, the form or shape stability thereof, as well as the horizontal movement thereof are effected by transverse rods or bars, which are arranged in the lower loop bend and in the vicinity of the container bottom move from the textile strand inlet or entry side to the outlet or discharge side thereof, and by a flow directed upwardly between the transverse rod or bars; the horizontal movement is aided by a horizontal transverse flow of the treatment liquid.

Since the textile material to be treated generally has a specific weight which is equal to or less than that of the treatment liquid, the textile strand tends to float. However, this floating is irregular, and allows no form or shape stability of the loops to result or be maintained; additionally, the loops are to be subjected to a transverse movement. The upwardly directed hydrodynamic flow, preferably, though, an air or vapor flow, in connection with the transverse rods or bars moving in the vicinity of the container bottom in the lower loop bends, has an advantage in that this succeeds, with a very small air, gas, or liquid quantity, to form a high, form-stable, smooth-wall loop, especially however to maintain the same which the loop package is moved horizontally.

Referring now to the drawings in detail, the apparatus utilized for application of the present invention method is provided with a container G which is closed in a vapor-tight manner and is filled with a treatment liquid B, the level S of which extends as far as to the vicinity of the upper container edge. The front wall V of the container G has a surge tank (Wasserschloss) 1, and a cold-water surge tank 2 is located across therefrom at the rear wall R of the container. The textile web or strand T to be treated is drawn into the treatment liquid B by the tension or delivering roller pair 3 and is supplied to a loop-forming nozzle 4, the stream of which is directed vertically or substantially vertically upwardly.

A roller chain 5 is guided in the vicinity of the front wall V, the rear wall R, the lower segment of the container, as well as in the vicinity of the level S of the treatment liquid. This roller chain 5 comprises individual chains which are spaced from one another and between which crosspieces or transporting rollers 6 and spacers **6*a* extend. The chain 5 is guided around the reversing rollers 7–7*e* approximately upon a rectangular path, whereby the two individual chains of the roller chain 5 are spaced farther apart than the width of the textile strand T. The arrangement and guiding of the roller chain 5 is such that the chain, which moves in a counter-clockwise direcion, reduces the spacing of the transporting rods to 1/10 when viewed in the direction of movement after the loop-forming nozzle 4, i.e., for instance a reduction of the spacing of the transporting rods from 500 mm to 50 mm. In so doing, downwardly hanging or suspended loop segments or chain loops 11 are formed, the length of which corresponds approximately to half the spacing of the chain crosspieces or transporting rollers 6, i.e., in the aforementioned example, the length of the chain loops 11, at a spacing of the crosspieces or transporting rollers of 500 mm, equals 250 mm. The chain 5 is driven by the reversing chain gears or wheels 7b and 7d. The loop height or level, which reproduces the heat content of the container, can be changed by a continuous or stepless control drive between the delivering roller pair 3 and the chain wheels or gears 7b and 7d**.

A deck, or an overlay or support 9 formed by two rails maintained in spaced relationship to each other, is arranged above the bottom GB of the container G. The crosspieces or transporting rollers, which are round in cross section, ride or roll-off on the support or overlay 9. For this purpose, the rod support formed by the deck or double rail is inclined from the entry side of the textile strand as far as to the discharge side thereof. Due to this inclination, described in greater detail in the following paragraphs, the horizontal movement of the textile strand loop package P is effected from the left to the right as seen in FIG. 1, i.e., is effected from the material inlet or entry side toward the material outlet or discharge side.

While the loop-forming nozzle 4 takes care of the lifting or floating of the textile strand and the formation of the loops 10, the loops 12, which form in their full height and permit the loop package P to result, are kept in their position and in a form-stable manner thereby that on the one hand the lower end of the loops is held by the crosspieces or transporting rollers, and on the other hand there is provided a lifting or floating support in the form of an aerodynamic and/or hydrodynamic flow between crosspieces or transporting rollers. This comprises several mantles or casings 14 which are spaced from each other and are arranged on the inclined traverse or bar L. The side walls of the casings 14 form a nozzle slot 15 which extends over the width of the container G. Pipes or tubes 16 provided with nozzles or openings are arranged or secured on the transverse or bar L in the feeding or advancing direction of the loop package P between the nozzle slots 15; air or vapor discharges vertically upwardly from the tubes 16.

In the casings 14, which form a downwardly open lower chamber 30, there is arranged a pipe or tube 31 having discharge nozzles 33 from which air, vapor, or a gas can discharge, and which accordingly form an ejector 34 between the walls 35 of the casing 14. An upwardly directed flow is generated hereby between the transporting rods or bars 6, as represented by a reference numeral 32 in FIG. 3. In this connection, bubbles 32a rise in the loops 12, at the upper end of which a formstable loop head 29 is formed.

The transporting of the loop package P is aided by a horizontal flow of the treatment liquid, which results from a mixture (of liquids) discharging from the wall 18 of a distributing container K on the entry side of the container G. The mixture (of liquids) discharges horizontally in rows or in a surface-like manner from the openings 18a of the wall 18, and pushes or shifts the loop package P ahead of it as far as to the outlet or discharge end of the container, where a similar wall 17 of a box $K_1$ is provided, through the inlet openings 17a of which the mixture is withdrawn and is again supplied to the container K in the cycle by a pump, or, as the case may be, also by a heat exchanger. At the outlet or discharge end of the textile strand from the package P, there is arranged a pendulum or swinging guide 13 which controls or regulates the speed of a withdrawal mechanism or a squeezing mechanism at the housing outlet or discharge.

So that the air or vapor bubbles can pass between the crosspieces or transporting rollers 6, into the loops 12, the crosspieces or rollers 6 are kept in their spaced relationship by non-illustrated spacing discs on the crosspiece or roller ends, while the crosspieces or rollers 6 glide or roll downwardly at an incline upon the support or overlay 9.

The container G, at the upper segment thereof, is provided with a viewing window 20 through which the loop package can be observed in the interior of the housing. A float valve and overflow 21 assure a constant mixture level. The adjustable pressure monitor 22, with the withdrawal flue 23, guarantees a constant mixture temperature in the container. The cover plates 24 lie in a water ring 25 which serves as a vapor blockage.

As recognizable from FIG. 1, the crosspieces or rollers 6, with their lateral roller chains, run in the direction of movement after the reversing wheel or gear 7b against the textile strand T and take the latter along therewith, accompanied by the formation of the first loop by means of the nozzle 4. Thereafter, the crosspieces or rollers are aligned sequentially while maintaining the spacing X (FIG. 3) upon the support or overlay 9, so that the respective lower chain loops 11 are formed, which are released again at the end of the overlay or support 9.

From the foregoing, it is recognizable that the crosspieces or rollers 6 with the chain loops 11 respectively fastened thereto, are specifically so heavy that the crosspieces or rollers sink in the liquid even against the lifting or buoyancy flow, i.e., they roll or glide off on the support or overlay 9, and under such circumstances lie in the lower bend of the loop Sch.

Figure 6:
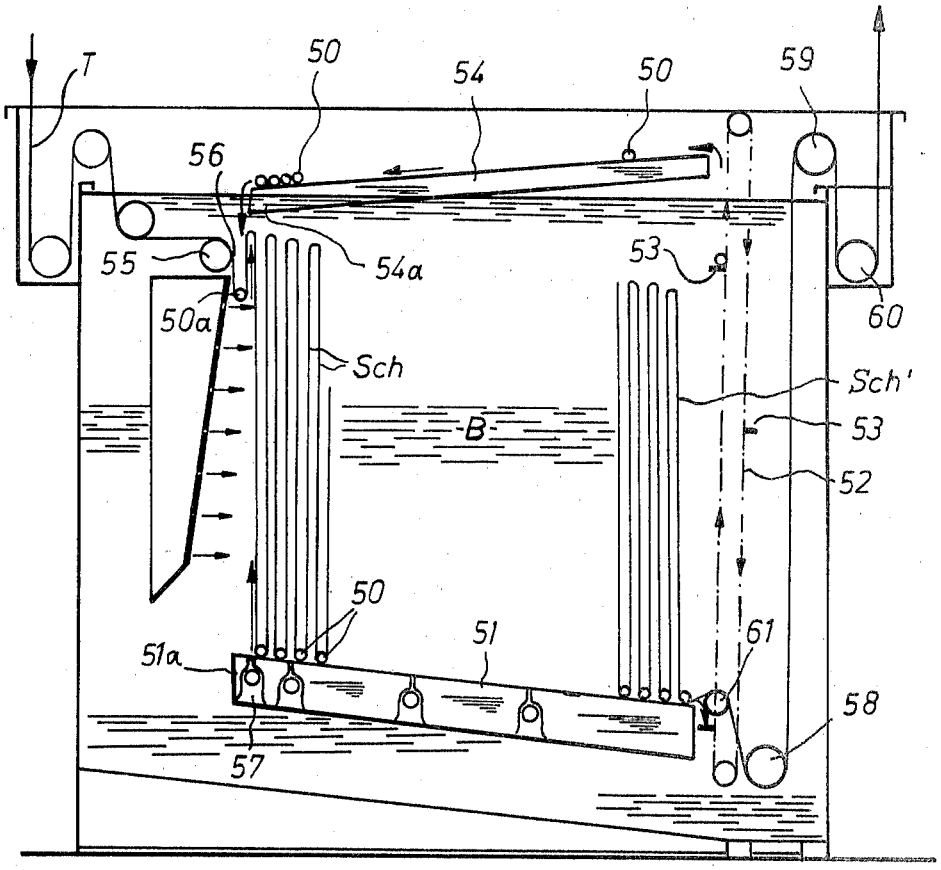
FIG. 6 illustrates a further embodiment of the method and apparatus in accordance with the present invention.

This is also the situation with the embodiment according to FIG. 6. Here the rollers 50 again roll or glide upon a lower inclined support or overlay 51 from the inlet or entry side to the outlet or discharge side of the container with the bath liquid B. At the end of the support 51 there is arranged a vertical lift mechanism 52 with followers 53, by means of which the rollers 50 departing the support 51 are taken along upwardly and are delivered to an overlay or support 54, which is inclined opposite to the support 51 and upon which the rollers 50 roll off toward the left as seen in FIG. 6. At the front 54a in a particular cycle, a roller 50a is dropped or deposited upon that segment 56 of the textile strand which adjoins the reversing roller 55. Since at the start of beginning 51a of the support 51 a strong upward flow is generated by the nozzle 57, the roller 50a can sink or drop down in the liquid as far as to the support 51, and there can roll downwardly, while the loop formed is maintained and is moved to the right as with the embodiment according to FIG. 1. The textile material strand T leaves the treatment container, as in FIG. 1, by means of the rollers 58, 59, 60, in which connection the last loop Sch' is drawn-in by the roller 61.

In summary, the present invention provides a method for continuously treating strand-like textile material which is transported horizontally in vertical loops, by means of transverse rods or bars, through a treatment liquid, particularly a hot mixture of liquids; the formation of the loops occurs by means of a vertical flow. The loop formation, the maintaining of the formed loop, the form or shape stability thereof, as well as the horizontal movement thereof are effected by transverse rods or bars, which are arranged in the lower loop bends and in the vicinity of the container bottom move from the textile strand inlet or entry side to the textile strand outlet or discharge side, and by a flow directed upwardly between the transverse rods or bars; the horizontal movement is aided by a horizontal transverse flow of the treatment liquid. The horizontal flow may be generated by treatment liquid circulated with a pump. The horizontal flow may be generated over substantially the height and width of the loop. The loops may be brought to the region of the horizontal flow by upward pressing of the textile strand sections.

The apparatus for carrying out the foregoing method includes a cubic or quadratic liquid container, and an endless chain which is guided in the vicinity of the container bottom and the container end walls and is provided with transverse rods or bars of greater width than that of the textile strand to be treated. The apparatus further includes an air permeable and liquid permeable stationary support or overlay 9 which is inclined relative to the horizontal from the textile strand inlet or entry side to the textile strand outlet or discharge side of the container. The apparatus also includes a pair of rails in the vicinity of the container bottom GB for the transverse rods or bars, of the endless chain, moved thereon, and upwardly directed nozzles 33 located below the support or overlay 9, as well as a device 17, 17*a* 18, 18*a* for generating the transverse flow represented by arrows F.

The ends of the transverse rods or bars on the endless chain may be provided with spacer discs by means of which the transverse rods or bars are kept slightly spaced from one another upon the support or overlay 9 or upon the pair of rails. The nozzle may be formed by an air-, vapor-, or gas-supplying pipe or tube 31 having nozzle openings, and by a mantle or casing 14 filled with treatment fluid and surrounding the pipe or tube 31. The device 17, 18, which generates the transverse flow of arrows F and is arranged at or in the vicinity of the container end walls V, R, may be provided with horizontally directed discharge or inlet openings or nozzles 17*a*, 18*a* which are arranged in rows or layers. The discharge or inlet openings or nozzles 17*a*, 18*a* of the devices 17, 18, which generate the transverse flow of arrows F, may be arranged along a wall inclined relative to the loops.

The present invention is, of course, in no way restricted to the specific disclosure of the specification and drawings, but also encompasses any modifications within the scope of the appended claims.

What is claimed is:

1. A method of continuously treating strand-like textile material in a container of treatment liquid, said method including the steps of:

passing said textile material through said treatment liquid;

generating vertical flow in said container to form vertical loops in said textile material;

transporting said looped textile material substantially horizontally through said treatment liquid with transverse bars;

respectively arranging said bars in the lower bends of said loops in the vicinity of the bottom of said container;

utilizing said transverse bars to effect said loop formation and to maintain the formed loops and their form stability;

moving said transverse bars from the textile strand inlet side to the textile strand outlet side of said container;

directing said vertical flow upwardly between said transverse bars; and generating horizontal transverse flow of said treatment liquid to aid said horizontal transport of said looped textile material.

2. A method according to claim 1, which includes the step of circulating said treatment liquid with a pump to generate said horizontal flow.

3. A method according to claim 1, which includes the step of generating said horizontal flow over substantially the height and width of said loops.

4. A method according to claim 3, which includes the step of pressing sections of said textile strand upwardly to bring said loops into the region of said horizontal flow.

* * * * *